United States Patent [19]

Sturtevant

[11] Patent Number: 5,017,037

[45] Date of Patent: May 21, 1991

[54] POCKET DISPLAY AND PROTECTIVE ENCLOSURE

[76] Inventor: Emily B. Sturtevant, 3408 Lowell St., NW., Washington, D.C. 20016

[21] Appl. No.: 418,209

[22] Filed: Oct. 6, 1989

[51] Int. Cl.[5] ..... B42F 13/00; B42F 13/12

[52] U.S. Cl. ..... 402/73; 281/15.1; 402/502; 402/79

[58] Field of Search ..... 402/502, 503, 79, 73; 281/29, 30, 31, 34, 15.1

[56] References Cited

U.S. PATENT DOCUMENTS

| | | | |
|---|---|---|---|
| 315,327 | 4/1885 | Patterson | 40/537 |
| 2,558,996 | 7/1951 | Ullmann | 281/20 |
| 2,757,939 | 8/1956 | Fenkel | 281/20 |
| 2,850,294 | 9/1958 | Ortis et al. | 281/31 |
| 4,011,940 | 3/1977 | Neal et al. | 281/29 X |
| 4,100,684 | 7/1978 | Berger | 281/30 |
| 4,170,423 | 10/1979 | Bourbon | 402/502 |
| 4,227,328 | 10/1980 | Clipper, Jr. | 402/73 |
| 4,516,871 | 5/1985 | Leitmann | 402/79 |
| 4,630,843 | 12/1986 | Willat | 281/30 |
| 4,744,689 | 5/1988 | Sternberg | 402/73 |
| 4,807,909 | 2/1989 | Lapsker | 281/15.1 |

*Primary Examiner*—Paul A. Bell

[57] ABSTRACT

An assembly of superposed transparent flexible plastic leaf-like pockets connected at one edge for folding and each having therein a removable sheet to mount keepsake memorabilia for leafing display through the pocket walls; and a protective enclosure for the assembly facilitating storage and transport thereof without folding or collapse of the pockets and included keepsake material.

10 Claims, 2 Drawing Sheets

POCKET DISPLAY AND PROTECTIVE ENCLOSURE

BACKGROUND OF THE INVENTION

This invention relates to improvements in a composite compartmented assembly for selective storage, transport and/or display of various types of memorabilia such as art work, drawings, writings, photographs, and including such keepsake materials as may be developed by children during their formative years.

Such materials have been accumulated in albums of various types, usually in book, loose leaf or scrap book form. In conventional photograph albums, pictures are attached to opposite sides of pages assembled in book form. Patterson U.S. Pat. No. 315,327 shows a scrap book with pocketed leaves to removably receive a cutting board permitting slitting of the leaves for mounting pictures or the like. Ullmann U.S. Pat. No. 2,558,996 shows a floatable childrens' book with transparent plastic sheets forming a waterproof sealed air space therebetween in which visible material may be viewed through the sheets. Ortis et al. U.S. Pat. No. 2,850,294 shows a picture album in which each pocketed leaf includes a central pressed board mounting within pockets with picture framing apertures within which pictures may be inserted and removed from the framing upon release of the leaf assembly from its mounting. Fenkel U.S. Pat. No. 2,757,939, shows a protective enclosure for a book which may be read upon opening of the enclosure.

OBJECTS OF THE INVENTION

An object of the invention is to provide a composite compartmented assembly including a box-like compartment for protective storage and transport of multiple pocketed leaf-like compartments mounted together at one margin thereof and in each of which memorabilia are mounted.

Another object of the invention is to provide an assembly of the above type in which the box-like compartment includes a removable cover permitting viewing of the memorabilia through flexible transparent plastic walls of the leaf-like compartments as they may be turned in the manner of conventional book pages.

A further object of the invention is to provide an assembly of the above type in which each of the leaf-like compartments or pockets formed by the flexible sheeting walls includes an insertable and removable mounting sheet of paper or the like for mounting memorabilia on both sides thereof and to assist in preventing collapse and folding of the pockets when the leaf-like compartments are inclined from the horizontal when viewed within the protective compartment with its cover removed or when removed therefrom for separated viewing.

A still further object of the invention is to provide leaf-like compartments or pockets of the above type with end superposed mounted margins thereof secured to a relatively rigid backing member substantially coextensive therewith for positioning therein and ease of handling when removed from the storage compartment.

The above and other objects of the invention will in part be obvious and will be hereinafter more fully pointed out in connection with referenced description of the accompanying drawings in which.

Figure 1:
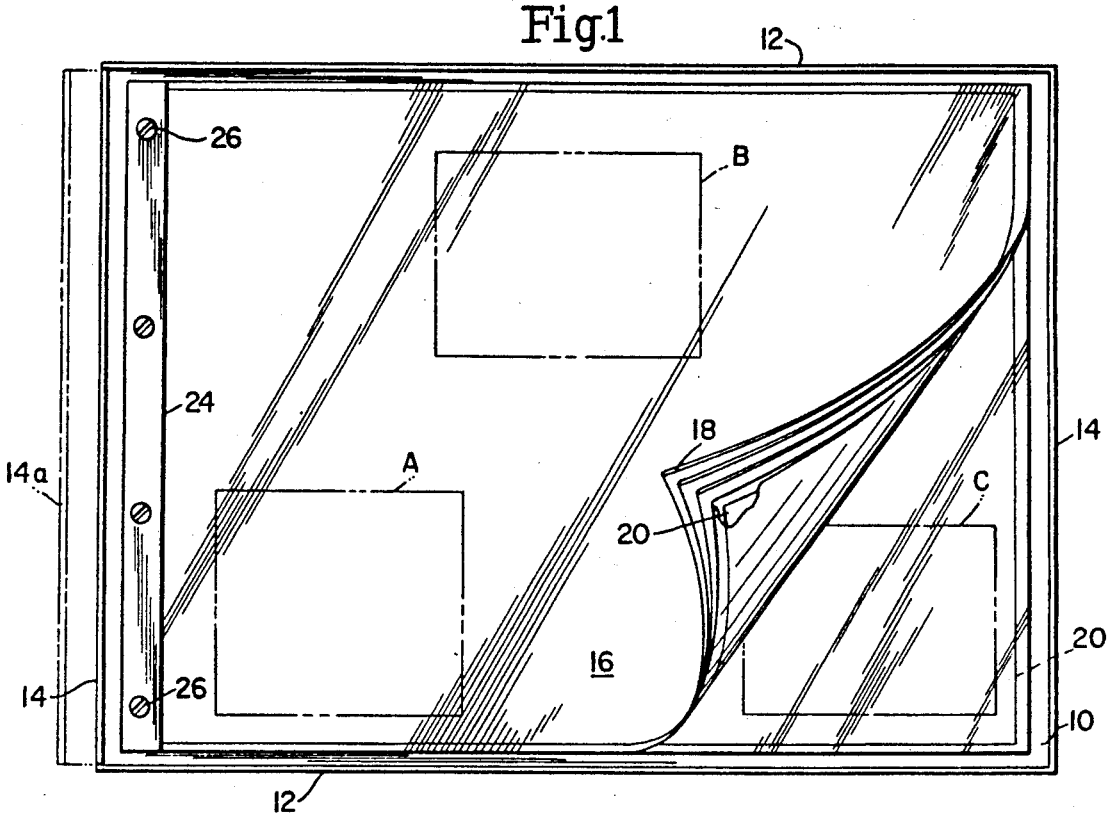
FIG. 1 is a top plan view of the pocketed leaf assembly in a box-like compartment with its cover removed.
Figure 2:
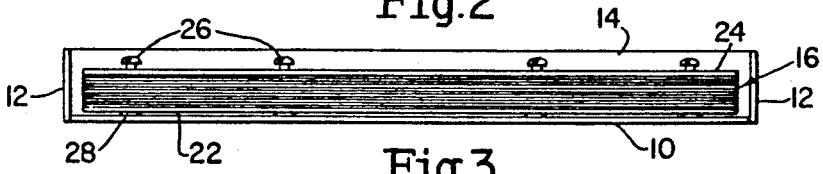
FIG. 2 is an end view of FIG. 1 with that end of the compartment open.
Figure 3:
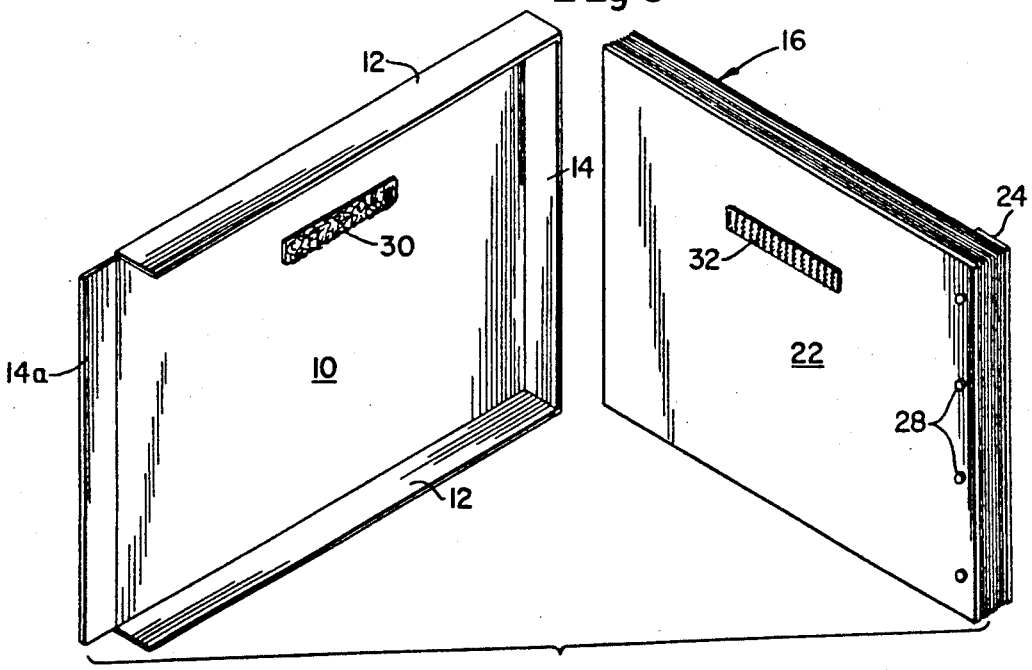
FIG. 3 is an exploded perspective view of the open compartment and the leaf assembly illustrating one form of attachable connection therebetween.

An outer box-like protective body compartment, without applied cover, and an inner multiple leaf-like compartmentation inserted therein, are shown in FIGS. 1 and 2 as a composite assembly, while the parts are shown exploded in FIG. 3. The box-like compartment may be formed of cardboard having sufficient thickness and density to provide the desired stiffness and includes a bottom wall 10 and upstanding peripheral walls illustrated as side walls 12 and end walls 14, 14*a*, the latter being pivoted along the bottom wall for permissive opening as may be desired for finger access to the inner compartmentation. The inner compartmentation 16 includes a plurality of superposed leaf-like compartments each formed of transparent inertly flexible sheet plastic material providing an open end 18 receiving an insertable and removable sheet of foldable but collapse resistant paper 20 which is foldable but resistant to collapse of the pocket forming plastic material. These sheets of paper provide mounting surfaces for memorabilia to be viewed through the transparent plastic material as illustrated by the random designations A, B, C, which may be of various sizes and shapes.

The inner compartmentation or pocket assembly has the several leaf-like pockets superposed in registry with edges, other than the pocket opening edges and illustrated as being opposite thereto, removably mounted to a stiff baseboard backing 22 of cardboard or the like which is dimensionally coextensive with the bottom of the leaf-like pocket assembly. The edges to be mounted to the baseboard are confined along the upper edges thereof by a clamping strip 24 also of stiff cardboard. The baseboard 22, clamping strip 24 and the edges of the leaf-like pockets confined therebetween are provided with spaced apertures therealong to receive telescopic and complementally threaded post 16 and screw 28 elements to mount the assembly although other mounting means may be employed. The leaf-like pockets may be formed from tubular transparent flexible stock material with one edge thereof properly aligned for apertures but these aligned edges may be secured by heat sealing, pressure sensitive adhesive, stapling or the like prior to the formation of the spaced apertures for the fasteners. As shown in FIG. 3, cooperative Velcro fastening strips 30, 32 may be secured in complemental positions on the inner surface of the bottom 10 of the box-like compartment and the backing 22, respectively, for fixing the relative positions in the assembly. These Velcro fastenings may be variously positioned for the mounting purposes and may assume various cooperative shapings for the purpose of closely confining the pocketed assembly within the box-like compartment.

Figure 5:
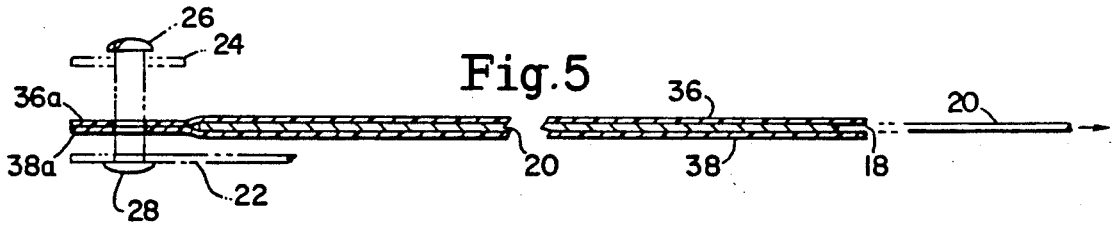
FIG. 5 is a longitudinal enlarged section through a single pocketed leaf.

An individual leaf-like product is shown in the longitudinal section of FIG. 5. The opposite sides 36, 38 of the highly flexible transparent plastic sheeting have the free edges thereof unsecured to provide the opening 18. The plastic sheeting, if formed from tubular stock material, will have the longitudinal edges closed but if formed from separate plastic sheets, these edges will be secured as by heat, sealing, or the like. The opposite layered edges 36*a*, 38*a* of the sides of the pockets are superposed for formation of registering apertures 40 therethrough to accommodate the post 26 and screw 28 fastener mountings. Before such aperture forming, the edges 36*a*, 38*a* may or may not be sealed together as previously indicated. The opening 18 may be provided along a longitudinal edge of the pocket sides if so desired, but as illustrated, the opening 18 is opposite the layered edges 36*a*, 38*a*, and the mounting sheet 20 may be inserted and removed from the pocket in order to mount thereon, or to remove and replace, the memorabilia on opposite sides thereof to be viewed through the transparent sides of a pocket when positioned therein. When so positioned within the pocket, the mounting sheet 20 with its resistance to planar collapse prevents the normal tendency of the plastic material of the pockets toward planar collapse when the assembly is stored or transported in an edgewise, as distinguished from a flatwise, position. The mounting sheet is substantially coextensive with the interior surface of a pocket to assist in this prevention of collapse, but this mounting sheet terminates before the superposed and clamped edges 36*a*, 38*a* of the pocket sheeting to permit hinged leafing of the pockets in the nature of book or album leaves.

Figure 4:
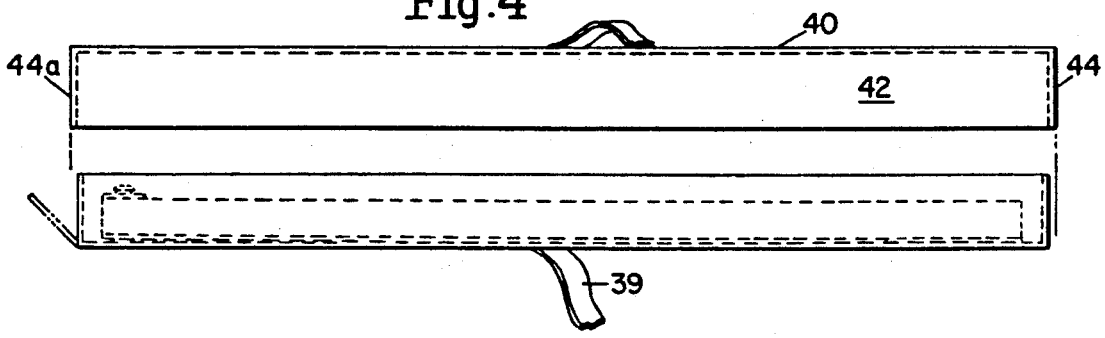
FIG. 4 is a side elevation of the assembly of FIG. 1 with the compartment cover in position for closing application thereto.
Figure 6:
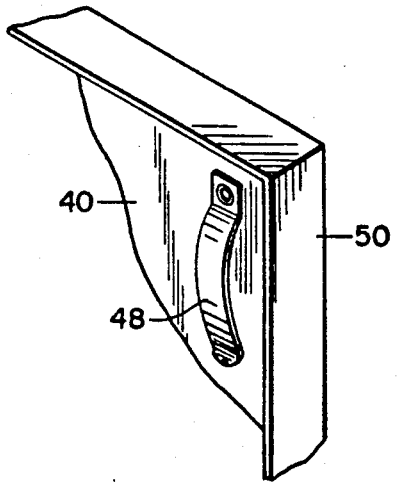
FIG. 6 is a fragmentary perspective view of a corner interior of the compartment cover with one type of restraining means to assist in preventing folding and collapse of the pocketed leaf assembly when stored or transported in the closed compartment regardless of the positional orientation thereof.
Figure 7:
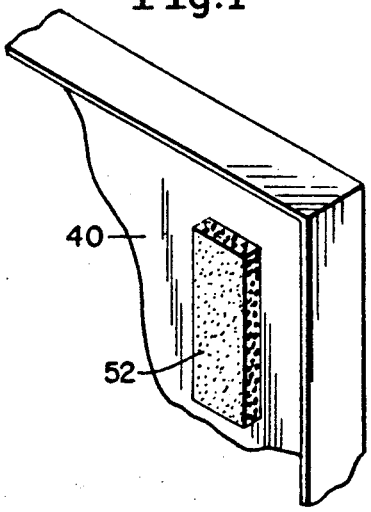
FIG. 7 is a view similar to FIG. 6 and showing another form of restraining means.

In FIG. 4, essentially the bottom box-like compartment of FIG. 1 is shown in side elevation with a cover in position for closing application and a strap 39 or similar securing means may be provided to secure the top to the bottom compartment. The cover includes a top closing wall 40 and peripheral side wall 42, and end walls 44, 44*a* to engage around the upstanding walls of the bottom compartment with one of the end walls 44*a* maintaining the pivoted wall 14*a* in closed position. In general the inner compartmentation 16 of the multiple leaf-like pockets will be of sufficient thickness dimension so that the applied cover will be sufficiently close to restrain any tendency of the leaf-like pockets to fold along the edges and at corners thereof remote from the mounted opposite end thereof when the assembly is stored or transported in other than a flat position. However, as a further restraint against such folding tendency, as well as to augment the restraint against collapse provided by the mounting sheets 20, when the laminar pocketed assembly is of lesser dimensional thickness, the cover may include restraining means in various forms and locations such as shown for illustrative purposes in FIGS. 6 and 7. In FIG. 6, there is shown a light-leaf spring element 48 with one end free and the other end secured, as at 50, to the inner surface of the closing top wall 40 of the cover, In FIG. 7, the restraining means is illustrated as a strip of foam rubber 52 or similar form of cushion material. The fold restraining elements may be selectively positioned adjacently along edges of the cover or at corners thereof remote from the mounted edges 36*a*, 38*a*, in interfering relationship with the surface of an adjacent pocket assembly to prevent any tendency of the same to fold or collapse inwardly during edgewise storage or transport of the closed assembly. These restraining elements are designed to lightly engage the surface of the uppermost pocket when desired as the cover is applied to the bottom compartment.

The highly flexible transparent plastic material of the leaf-like pockets is of a material, such as polyethylene or other, which does not have a tendency to adversely affect the internally mounted memorabilia, as has been found in connection with some vinyl plastics. The size of the compartmentation may be varied depending on the nature of the material to be mounted. For instance, the size might be such as to accommodate large sizes of children's school work sheets in flat form. However, any smaller size may be used for mounting photographs, writings, and the like in single or multiple array. The composite assembly thus provides for display of keepsake materials of various sizes on opposite sides of mounting sheets for viewing through the transparent pocket walls during leafing of the pockets; and the protective box-like enclosure provides for storage and transport of the leaf-like assembly without folding or collapse of the pockets. In turn, the pivoted wall of the box-like compartment may be opened for finger access to the leaf-like assembly for leafing of the pockets as for removal of the pocket assembly depending on the location of the pivoted wall, and the releasable mounting of the pockets permits bodily removal, addition or replacement thereof. The mounting sheets 20 are formed of various materials having the indicated properties of foldability and resistance to planar collapse, such as various forms of paper, including so-called construction paper.

Variations in details of construction and arrangement of parts may be made without departing from the spirit and scope of the appended claims.

The invention is claimed as follows:

1. A multiple leaf-like assembly for leafing display and containment of keepsake memorabilia, and comprising:

a plurality of leaf-like superposed pockets each formed of transparent flexible plastic sheeting forming an interior pocket space with one edge of each pocket remaining open for access to the interior space and with another edge of each pocket providing a pocket mounting area;

fastener means for securing together the mounting areas of the pockets;

a plurality of foldable mounting sheets, one disposed within each pocket and substantially coextensive with the interior pocket space to resist collapse or inadvertent folding of the pockets with the assembly in upwardly inclined positions for viewing and terminating short of the mounting area of the corresponding pocket whereby to be freely insertable and removable from the pocket space for attachment and replacement of memorabilia to opposite sides thereof for viewing through the transparent walls of the pockets as they are leafed about the mounting areas;

and a relatively stiff backing member underlying the multiple leaf-like assembly with the fastener means cooperating with the backing member in securing the mounting areas of the pockets, and facilitating handling of the leaf-like assembly.

2. An assembly according to claim 1, wherein the open ends of each pocket are opposite the mounting areas thereof.

3. An assembly according to claim 1, wherein there is provided a clamping strip for clamping the mounted areas of the pockets between the strip and the backing member by the fastener means.

4. An assembly according to claim 3, wherein the fastener means includes post elements spaced along said backing member and extending through apertures in the mounting areas and the clamping strip permitting initial leafing of the pockets thereabout and facilitating removal and replacement of the mounting sheets without binding of the edges thereof adjacent to the mounting areas.

5. A composite compartmentation assembly for selective and protective storage, transport and display of keepsake materials, such as art works, photographs, drawings, writings and other memorabilia, and comprising:

an outer box-like protective and storage compartment defined by bottom and peripheral side walls, and a closure for the compartment during storage and transport thereof but removable therefrom to permit the interior of the compartment to be accessed and viewed;

a multiple leaf-like pocketed assembly disposed within said box-like compartment and comprising a plurality of leaf-like juxtaposed pockets, each pocket formed of transparent foldable and highly flexible plastic sheeting having little resistance to planar collapse, one edge of each pocket remaining open and with the remaining edges of each pocket defining interior pocket spaces, and with one edge of the said remaining edges of each pocket in juxtaposition to provide fastener mounting edge areas for the pocketed assembly;

fastener means connected to said fastener mounting edge areas for mounting said pockets and permitting leafing of each pocket thereabout;

a foldable mounting sheet disposed within each said pocket and substantially coextensive with the interior pocket space to resist edgewise planar collapse of the pocket sheeting when the composite assembly is in upwardly inclined positions as distinguished from a flat position, but terminating short of and independent of the fastener mounting areas whereby to be freely insertable and removable from a corresponding pocket for attachment and replacement of memorabilia to opposite sides thereof for viewing through opposite transparent walls of the pockets as they are leafed about the mounting area with the closure removed from the assembly;

and a reinforcing backing member underlying the multiple leaf-like assembly and generally coextensive therewith and with one edge thereof cooperating with the fastener means for mounting the pocket edges along the mounting areas, and facilitating removal of the pocketed assembly from the compartment for handling and replacement thereof in the compartment.

6. The assembly according to claim 5, wherein there are provided mutually engageable and disengageable connecting means between the backing member and the bottom of the box-like compartment for stabilizing the leaf-like assembly in the compartment.

7. The assembly according to claim 6, wherein the fastener means includes telescopic and cooperative post and screw elements extending through apertures in said backing member and the said mounting areas of the pockets.

8. The assembly according to claim 5, wherein the foldable mounting sheet is of a material resistant to planar collapse to assist in preventing such collapse of the pockets in the compartment with the closure applied as during storage or transport of the assembly in upright or inclined positions as distinguished from a flat position and for viewing with the closure removed.

9. The assembly according to claim 5, wherein one peripheral side wall of the box-like compartment is pivotal outwardly to facilitate manual gripping of the adjacent edge of the leaf-like pocket assembly for removal thereof, and wherein the closure includes a top closing wall and depending peripheral side walls outwardly telescoped with the side walls of the box-like compartment in closed position and maintaining the pivotal side wall of the box-like compartment in closed position.

10. The assembly according to claim 9, wherein the under surface of the top wall of the closure is provided with resilient means adjacent corner areas thereof remote from the mounted edges of the leaf-like assembly for permissive light engagement with adjacent surface portions of the uppermost leaf-like pocket to resist tendency of the pockets toward folding or planar collapse during storage or transport of the assembly in upright or inclined positions as distinguished from a flat position.

* * * * *